US007832601B2

(12) United States Patent
Zahn et al.

(10) Patent No.: US 7,832,601 B2
(45) Date of Patent: Nov. 16, 2010

(54) DISPENSING CONTAINER WITH NIPPLE DISPENSING HEAD

(75) Inventors: Walter Zahn, Columbia, SC (US); Shawn W. Miller, Columbia, SC (US); David Rocheleau, Lexington, SC (US); Mohammad R. Sadeghi, Columbia, SC (US); Bernd Hansen, Laufen (DE)

(73) Assignee: The Ritedose Corporation, Columbia, SC (US)

( * ) Notice: Subject to any disclaimer, the term of this patent is extended or adjusted under 35 U.S.C. 154(b) by 631 days.

(21) Appl. No.: 11/313,308

(22) Filed: Dec. 21, 2005

(65) Prior Publication Data

US 2007/0138215 A1 Jun. 21, 2007

(51) Int. Cl.
*B65D 47/10* (2006.01)

(52) U.S. Cl. ..... 222/541.9; 222/210; 604/212; 215/11.3; 425/113

(58) Field of Classification Search ..... 222/92, 222/95, 104, 107, 206–210, 212–214, 541.9, 222/1; 215/11.1, 11.3–11.4, 208; 604/212; 425/113

See application file for complete search history.

(56) References Cited

U.S. PATENT DOCUMENTS

| | | | | | |
|---|---|---|---|---|---|
| 2,041,351 | A | | 5/1936 | Jones | 221/60 |
| 2,252,119 | A | | 8/1941 | Edmonds | 30/125 |
| 2,724,863 | A | * | 11/1955 | Gudge et al. | 264/451 |
| 2,777,612 | A | | 1/1957 | Bensen | 222/209 |
| 2,953,170 | A | | 9/1960 | Bush | 141/18 |
| 3,104,032 | A | | 9/1963 | Hansen | 222/91 |
| 3,306,500 | A | | 2/1967 | Williams | 222/209 |
| 3,381,857 | A | | 5/1968 | Francis | 222/100 |
| 3,833,154 | A | | 9/1974 | Markowitz | 222/212 |
| 3,946,888 | A | | 3/1976 | Tonkin | 215/11 B |
| 3,995,772 | A | | 12/1976 | Liautaud | 222/83.5 |
| 4,020,978 | A | | 5/1977 | Szczepanski | 222/209 |
| 4,133,457 | A | | 1/1979 | Klassen | 222/212 |
| 4,238,040 | A | | 12/1980 | Fitzpatrick | 215/11 E |
| 4,469,250 | A | | 9/1984 | Evezich | 222/83.5 |
| 4,562,942 | A | | 1/1986 | Diamond | 222/386.5 |
| 4,637,934 | A | | 1/1987 | White | 426/117 |
| 4,657,151 | A | | 4/1987 | Cabernoch | 215/11 E |
| 4,678,092 | A | | 7/1987 | Rane | 215/11 E |
| 4,760,937 | A | | 8/1988 | Evezich | 222/95 |
| 4,787,536 | A | * | 11/1988 | Widerstrom | 222/212 |
| 4,842,165 | A | | 6/1989 | Van Coney | 222/183 |
| 4,966,312 | A | * | 10/1990 | Waring | 222/209 |
| 4,993,568 | A | | 2/1991 | Morifuji et al. | 215/11.1 |
| 5,101,991 | A | | 4/1992 | Morifuji et al. | 215/11.1 |

(Continued)

*Primary Examiner*—Kevin P Shaver
*Assistant Examiner*—Andrew Bainbridge
(74) *Attorney, Agent, or Firm*—Nelson Mullins Riley & Scarborough, LLP

(57) ABSTRACT

A dispensing container fillable with a liquid includes a squeezable reservoir for holding the liquid prior to dispensing; a nipple dispensing head which is integral with the squeezable reservoir and having a distal end and a proximal end; an outlet at the distal end of the nipple dispensing head for dispensing the liquid from the container; a passage interconnecting the squeezable reservoir and the outlet; and a stop disposed near the proximal end of the nipple dispensing head to prevent over-insertion of the dispensing head into a user's mouth when the container is used to dispense the liquid to the user. Containers that are filled with liquid and a method of making the containers are also described.

31 Claims, 6 Drawing Sheets

U.S. PATENT DOCUMENTS

| | | | | |
|---|---|---|---|---|
| 5,664,705 | A | 9/1997 | Stolper | 222/212 |
| 5,667,084 | A | 9/1997 | Duggal et al. | 215/11.4 |
| 5,678,736 | A * | 10/1997 | Hansen | 222/209 |
| 5,901,865 | A * | 5/1999 | Weiler et al. | 215/48 |
| 6,138,847 | A | 10/2000 | Johnson | 215/11.1 |
| 6,138,848 | A | 10/2000 | Fermo | 215/11.1 |
| 6,585,134 | B2 * | 7/2003 | Farris | 222/95 |
| 6,619,516 | B2 * | 9/2003 | Weiler et al. | 222/420 |
| 6,651,845 | B1 | 11/2003 | Schroeder | 222/83 |
| 6,669,013 | B1 | 12/2003 | Villanueva | 206/219 |
| D486,579 | S * | 2/2004 | Dunn | D24/196 |
| 6,737,091 | B1 * | 5/2004 | Littell, II | 426/117 |
| 6,874,665 | B2 * | 4/2005 | Doherty et al. | 222/541.5 |
| 7,487,894 | B2 * | 2/2009 | Zahn et al. | 222/541.9 |
| 7,513,397 | B2 * | 4/2009 | Zahn et al. | 222/541.9 |
| 7,562,796 | B2 * | 7/2009 | Zahn et al. | 222/541.9 |
| 2004/0182883 | A1 * | 9/2004 | Weiler | 222/153.07 |

* cited by examiner

DISPENSING CONTAINER WITH NIPPLE DISPENSING HEAD

BACKGROUND OF THE INVENTION (1) Field of the Invention

The present invention relates to a container for dispensing a liquid, and more particularly to a single-use container for dispensing a measured amount of a liquid to an infant.

(2) Description of the Related Art

The requirements for administering liquids in accurate amounts, such as is required for medicines, drugs, vitamins, and the like, are different than for the consumption of foods. This is particularly true where the subject is a child or infant. In the case of medicines, the amount of the liquid must be carefully controlled, and care must be taken to insure that the entire dose is successfully administered. When the subject is an infant, consumption may not be voluntary, and spillage or refusal is a danger. Moreover, when an infant is to receive the liquid, great care must be taken to avoid over-insertion of a dosing device into the mouth and throat, thereby causing choking.

In response to these requirements, various devices have been described that are designed to address one or more of the particular requirements. For example, dispensing devices having open, spoon-like bowls in which a liquid is offered are described in U.S. Pat. Nos. 2,252,119, 2,795,043, 4,888,188, 6,264,074, 5,154,318, 5,975,305, 4,841,637, 3,133,679, 3,473,221, 4,192,360, 4,830,222, 6,347,727, 3,946,652, D496,833, 3,116,152, among others. Such devices, however, in most cases, require the subject receiving the contents to voluntarily accept and remove the contents of the bowl when presented.

Spoons that provide for dispensing a liquid at or near the distal end of the bowl are described in U.S. Pat. Nos. 2,688,243, 5,038,974, 5,038,476, 201,369, D34,314, D52,688, D24,197 and D368,209. Many of these devices appear to depend upon either gravity, or an action by the recipient, to deliver the contents of the device.

Feeding devices or injecting devices having multiple parts, and which are designed for refilling and reuse, are described in U.S. Pat. Nos. 4,880,409, 5,556,008, 878,524, 1,661,595, 3,090,071, 3,410,457, 4,182,002, 5,062,550, among others.

Other liquid-filled disposable containers are described in U.S. Pat. No. 6,357,626.

Feeding or dosing devices having reservoirs with separate non-unitary tips that are connectable to the reservoir, generally of the style of a regular baby bottle having a removable nipple, are describe in U.S. Pat. Nos. 2,041,351, 2,953,170, 3,104,032, 3,306,500, 3,381,857, 3,833,154, 3,946,888, 4,133,457, 4,238,040, 4,469,250, 4,678,092, 4,760,937, 5,667,984, 6,138,847, 6,138,848, and 6,669,013. Nipples for use on devices of this type are described, for example, in U.S. Pat. Nos. 4,933,568 and 5,101,991.

Devices having collapsible reservoirs with non-unitary internal diaphragms are described in U.S. Pat. Nos. 2,777,612, 3,995,772, 4,020,978, 4,562,942, 4,657,151, 4,842,165, 6,651,845, and 6,737,091.

U.S. Pat. No. 4,637,934 describes a device that is non-unitary and opens with the application of a spike or the like, and lacks a breakable seal, and U.S. Pat. No. 5,664,705 describes a devices that has a non-unitary internal frangible seal that is broken by pressure to the side of a collapsible reservoir.

Yet, with the advances of the prior art, several problems remain to be overcome. For example, it would be useful to provide a dispensing container that did not have multiple parts and that could be made simply and inexpensively. It would also be useful if such dispensing container could be disposed after a single use. It would be useful if such a container could be designed to avoid requiring the user or another person to fill the container and/or measure the amount of liquid to be dosed, thereby improving accuracy, avoiding mistakes, and reducing waste. It would additionally be useful if such a container protected the integrity of the contents during packaging, transporting, selling and storage. Furthermore, it would be useful if such dispensing container could be safely used with infants, in particular avoiding over-insertion of the container into the mouth of the infant and thereby protecting against choking.

SUMMARY OF THE INVENTION

Briefly, therefore the present invention is directed to a novel dispensing container fillable with a liquid, the container comprising: a squeezable reservoir for holding the liquid prior to dispensing; a nipple dispensing head which is integral with the squeezable reservoir and having a distal end and a proximal end; an outlet at the distal end of the dispensing head for dispensing the liquid from the container; a passage interconnecting the squeezable reservoir and the outlet; and a stop disposed near the proximal end of the dispensing head to prevent over-insertion of the dispensing head into a user's mouth when the container is used to dispense the liquid to the user.

The present invention is also directed to a novel dispensing container having a liquid therein, the container comprising: a squeezable reservoir containing the liquid; a nipple dispensing head which is integral with the squeezable reservoir and having a distal end and a proximal end; an outlet at the distal end of the nipple dispensing head for dispensing the liquid from the container; a passage interconnecting the squeezable reservoir and the outlet; and a stop disposed near the proximal end of the nipple dispensing head to prevent over-insertion of the nipple dispensing head into a user's mouth when the container is used to dispense liquid to the user.

The present invention is also directed to a novel method of making a dispensing container having a liquid therein, the method comprising: extruding a polymer into a blow mold; closing the mold; forming a dispensing container comprising a squeezable reservoir designed to contain the liquid, a nipple dispensing head which is integral with the squeezable reservoir and having a distal end and a proximal end and having an outlet at the distal end of the nipple dispensing head for dispensing liquid from the container, a passage interconnecting the squeezable reservoir and the outlet, and a stop disposed near the proximal end of the nipple dispensing head to prevent over-insertion of the dispensing head into a user's mouth when the container is used to dispense liquid to the user; adding the liquid to the dispensing container; sealing the dispensing container; and removing the sealed dispensing container from the mold.

Among the several advantages found to be achieved by the present invention, therefore, may be noted the provision of a dispensing container that can be unitary and which does not require multiple parts, and which can be made simply and inexpensively, the provision of a dispensing container that can be disposable after a single use, the provision of a dispensing container that avoids the requirement of filling the container and/or measuring the amount of liquid to be dosed, thereby improving accuracy, avoiding mistakes, and reducing waste, the provision of a dispensing container that protects the integrity of the contents during packaging, transporting, selling and storage, and the provision of a dispensing container that can be safely used with infants, in particular a container that avoids over-insertion into the mouth of the infant and thereby protects against choking.

BRIEF DESCRIPTION OF THE DRAWINGS

FIG. 1 illustrates an embodiment of the present dispensing container, where

FIG. 2 is an illustration of an embodiment of the present dispensing container where

FIG. 3 shows partial cross-sectional cut-away views of an embodiment of the present dispensing container where FIG. 4 is an illustration of an embodiment of the present dispensing container where

Corresponding reference characters indicate corresponding parts throughout the several views of the drawings. The description of elements of the device with reference to one or more specific figures is not an indication that those same elements may or may not also appear in other figures.

DETAILED DESCRIPTION OF THE PREFERRED EMBODIMENTS

In accordance with the present invention, it has been discovered that a novel container for dispensing a liquid to an infant or child can be produced that has several advantages over earlier dispensing containers. In one embodiment, the present dispensing container is fillable with a liquid to be dispensed to a user. In another embodiment, the present container is filled with a liquid, sealed, and ready for use.

As used herein, the term "user" means a subject who receives the liquid contained in the device. In other words, the user is the subject to whom the liquid of the device is administered. The contents can be administered by the user or by another. For example, the device can be operated by an adult to administer medicine to a user, who could be an infant or young child.

The present container includes a squeezable reservoir for holding the liquid prior to dispensing and a nipple dispensing head which is integral with the squeezable reservoir and which has an outlet at its distal end for dispensing the liquid from the container. A passage interconnecting the squeezable reservoir and the outlet leads the liquid to the outlet, and a stop disposed near the proximal end of the nipple dispensing head prevents over-insertion of the dispensing head into a user's mouth when the container is used to dispense the liquid contents.

As mentioned above, the scope of the present invention is intended to include dispensing containers that are fillable with a liquid, and also those that have liquid contents added. Also included is a method of producing the novel container.

Figure 1A:
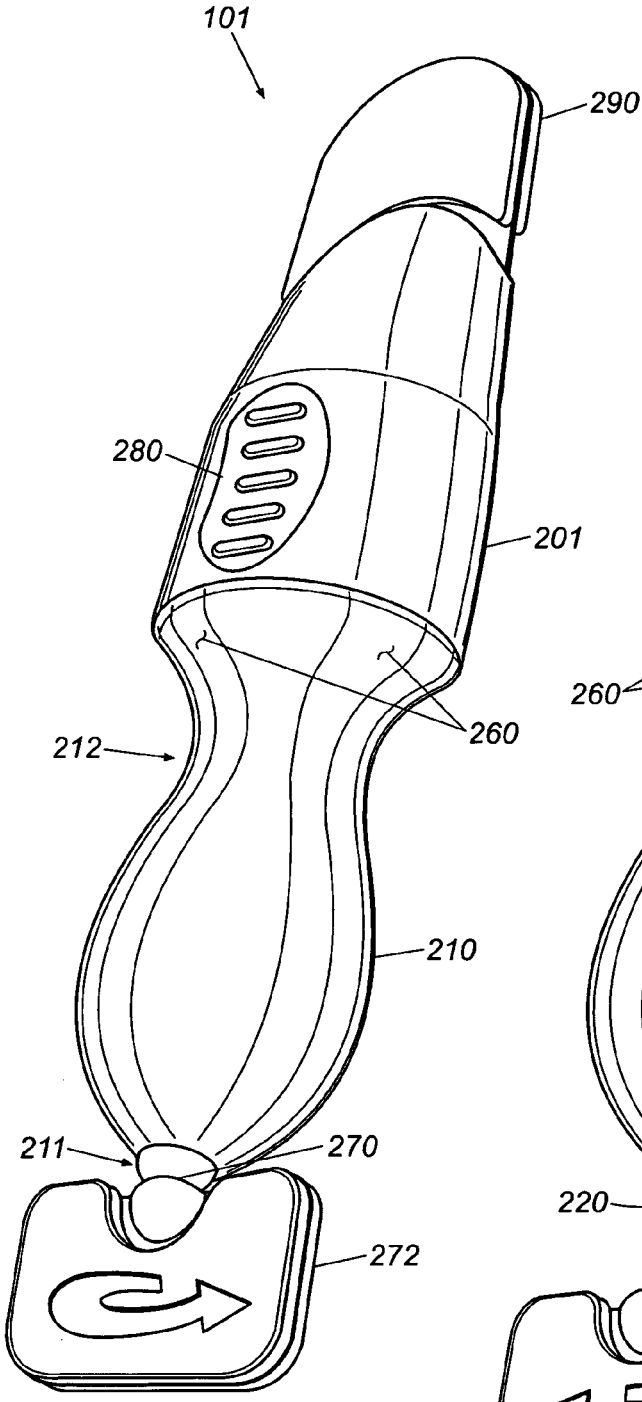
FIG. 1A shows a perspective view of the dispensing container having an intact breakable seal attached to an integral tab, and where
Figure 1B:
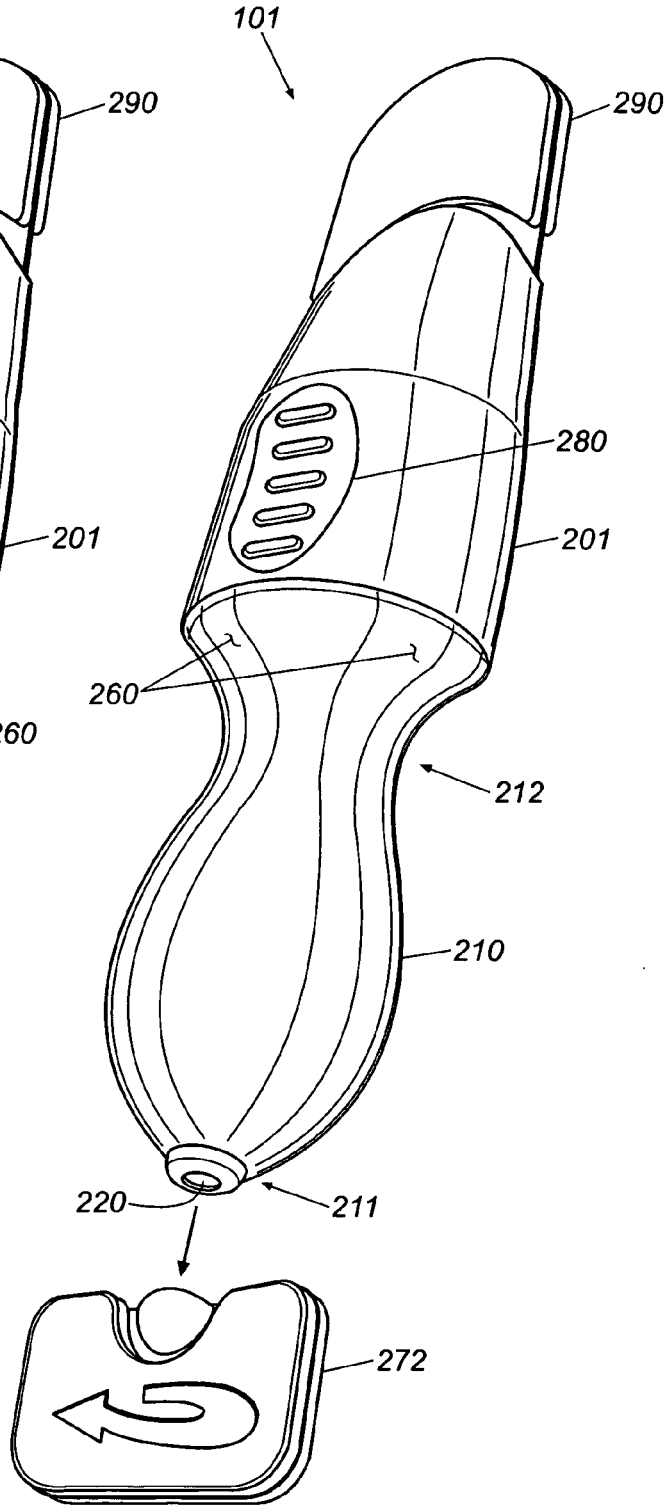
FIG. 1B shows a perspective view of the dispensing container in which the breakable seal has been broken, thereby exposing the outlet at the distal end of the nipple dispensing head, where the arrow indicates the general direction of removal of the tab and the removable portion of the breakable seal.

The present dispensing container can be described with reference to the several figures that accompany this specification. As shown in FIG. 1A-FIG. 1B, the dispensing container [101] comprises a squeezable reservoir [201] for holding a liquid prior to dispensing; a nipple dispensing head [210] which is integral with the squeezable reservoir and having a distal end [211] and a proximal end [212]; an outlet [220] at the distal end of the dispensing head for dispensing the liquid from the container; a passage [240] (shown in FIGS. 3A and 3B) interconnecting the squeezable reservoir [201] and the outlet [220]; and a stop [260] disposed near the proximal end [212] of the dispensing head [210] to prevent over-insertion of the dispensing head into a user's mouth when the container is used to dispense the liquid to the user.

In a preferred embodiment, the present dispensing container [101] is unitary. In other words, all parts of the dispensing container are integral with each other. In fact, as will be discussed in detail below, all parts of the container are preferably formed at substantially the same time from a single piece of material with all parts integral and continuous.

Figure 3A:
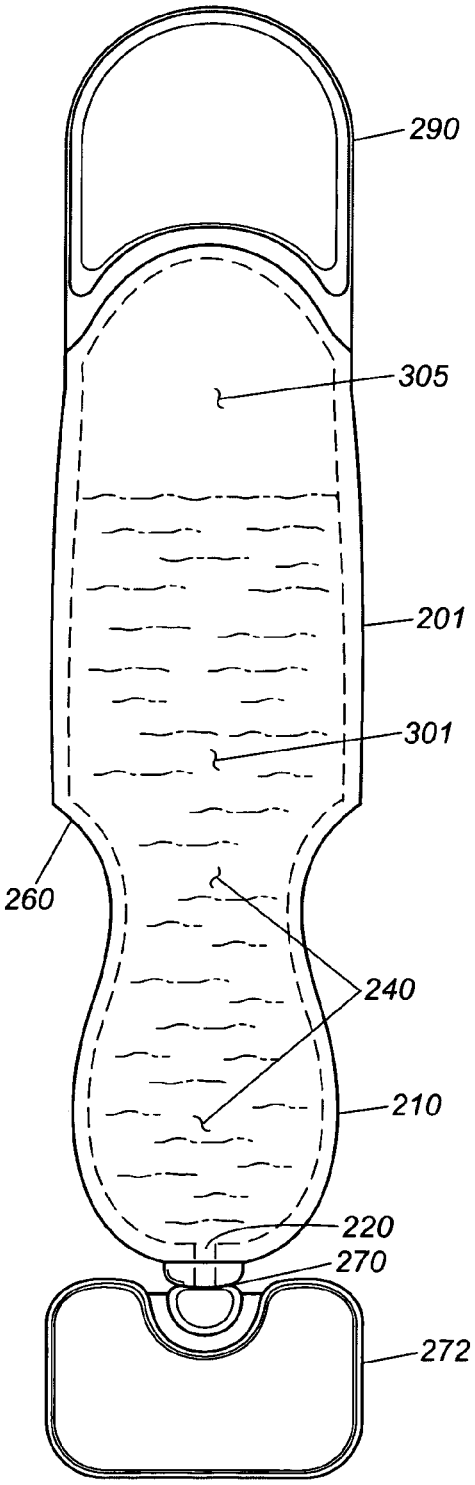
FIG. 3A shows a top partial cross-sectional view of the device in which the reservoir contains a liquid and also contains a gas-filled head space above the level of the liquid.
Figure 3B:
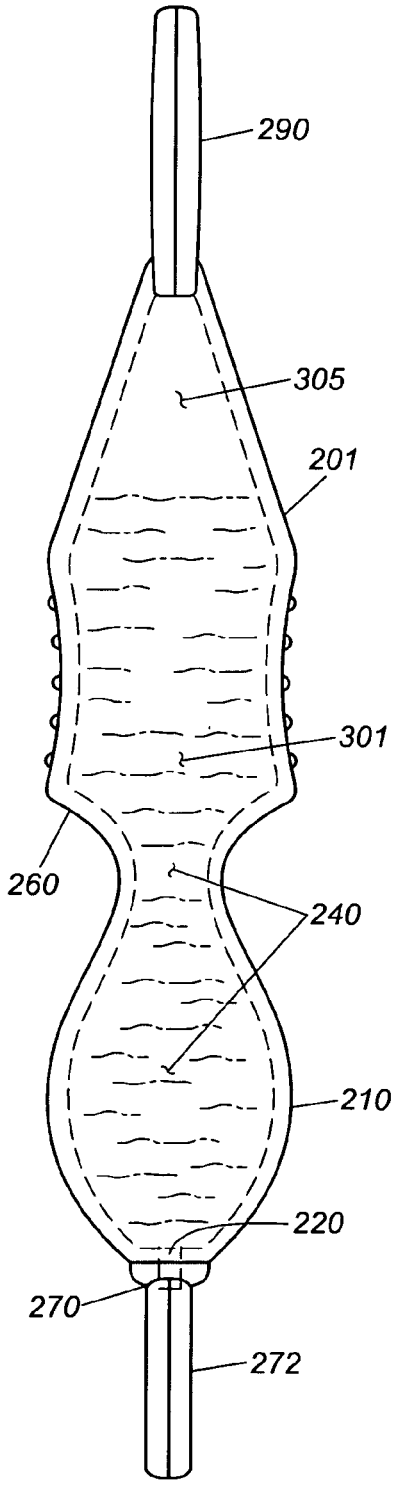
FIG. 3B shows a right-side partial cross-sectional view of the device having liquid in the reservoir and a gas head-space above the level of the liquid.

After the liquid contents of the container have been added to the squeezable reservoir [201], it is desirable that the outlet [220] is closed by a breakable seal [270] which reveals the outlet [220] when the seal is broken. The breakable seal [270] is preferably formed as an integral part of the nipple dispensing head [210] at the same time as, or immediately after, the nipple dispensing head itself is formed. In order to facilitate the easy removal of the breakable seal [270], it is preferred that the breakable seal is integral with a tab [272] which is designed for gripping between the thumb and forefinger for the purpose of breaking the seal. In one embodiment, for example, the user, or person administering the liquid, could break the seal by gripping the tab between thumb and forefinger, and applying a twisting motion. Breakage of the breakable seal [270] reveals the outlet [220] and permits the liquid [301], as shown in FIG. 3A and FIG. 3B to exit the dispensing container [101] at the outlet [220].

The tab [272] that is integral with the breakable seal [270] can have any shape that is suitable for its function. However, it is preferred that the shape of the tab generally conform to, or complement, the shape of the distal end [211] of the nipple dispensing head [210]. For example, if the distal end of the nipple dispensing head is rounded, then it is preferred that the surface of the tab [272] nearest the nipple dispensing head also be similarly rounded. If desirable, the tab [272] can also be imprinted with instructions or signals that indicate how to break the seal and reveal the outlet. One such signal is an arrow signal indicating a twisting action, as illustrated, for example, in FIG. 1A and FIG. 1B.

The squeezable reservoir [201] is a part of the container that is designed to contain some amount of a liquid [301]. In that embodiment of the invention where the reservoir has been filled with the liquid, the squeezable reservoir [201]

contains the liquid [301]. In some instances, the liquid can also be contained in the passage [240] in the nipple dispensing head [210]. Whenever the liquid capacity of the reservoir [201], or the dispensing container [101] is discussed herein, it is the total amount of liquid that is contained in the dispensing container [101] that is being described, irrespective of whether the liquid is located in the reservoir [201], the passage [240], or both. The reservoir [201] can be designed to have a volume sufficient to accommodate any amount of the liquid [301] that is desirable. It is preferable that the reservoir is designed to have a volume that is only slightly larger than the amount of the liquid that will be added. In order to simplify the loading of standard dosages of certain liquids, the reservoir can be made to hold a standard volume of liquid. For example, the squeezable reservoir [201] can have a capacity of about 1 ml of the liquid, or 2 ml, 5 ml, 10 ml, 15 ml, 25 ml, or any other volume of the liquid that is desired. An advantage of this feature is that an accurate amount of a liquid can be filled into the container without any action by the user. This reduces the chance of error in measurement and in dosage administration.

As used herein to describe the reservoir, the term "squeezable" is understood to mean that the reservoir can be deformed or crushed with a resulting reduction in volume by squeezing between the thumb and finger(s) of one hand.

Figure 2A:
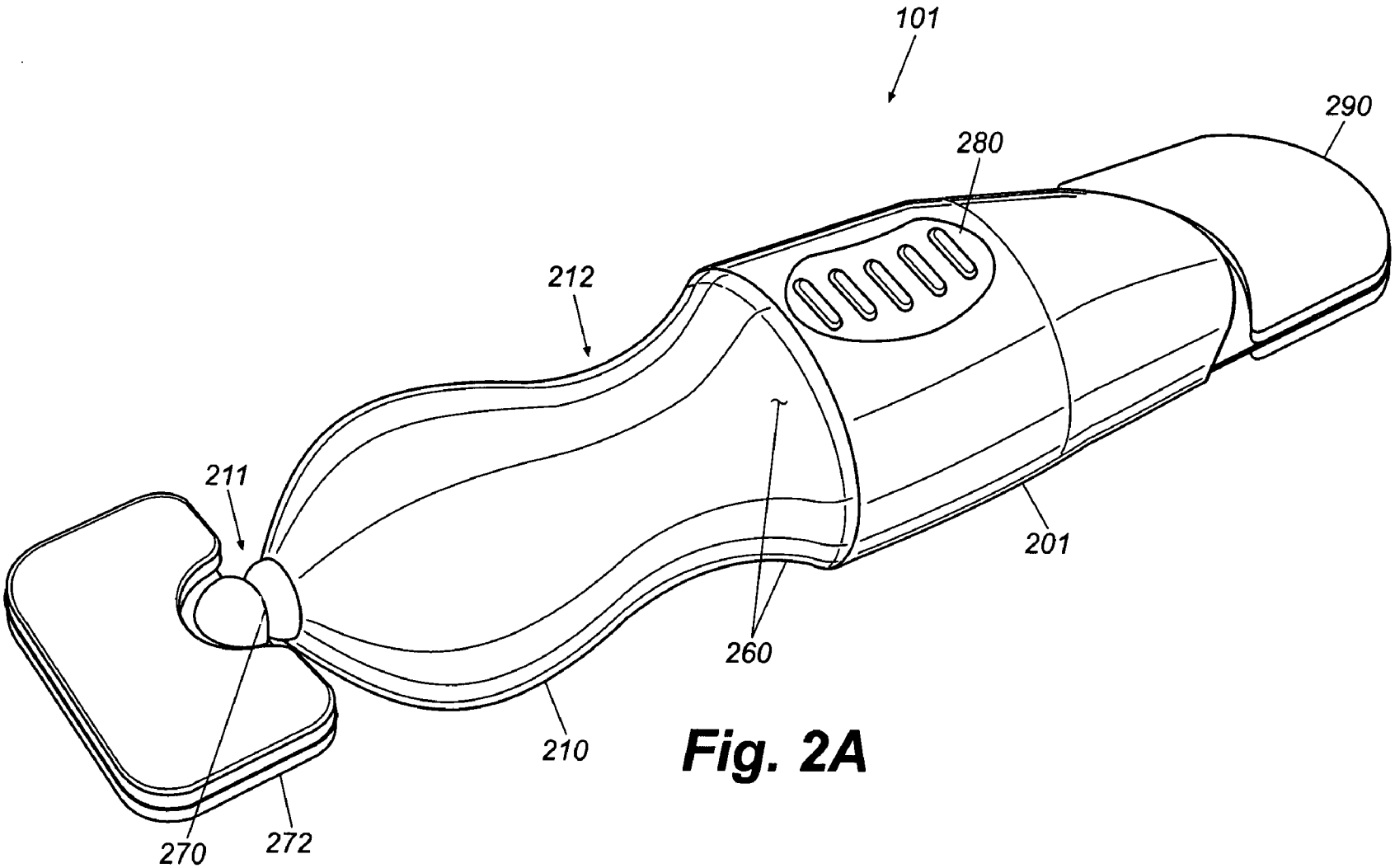
FIG. 2A shows a perspective view of the device and illustrating the breakable seal where the seal and tab are in place prior to removal.
Figure 2B:
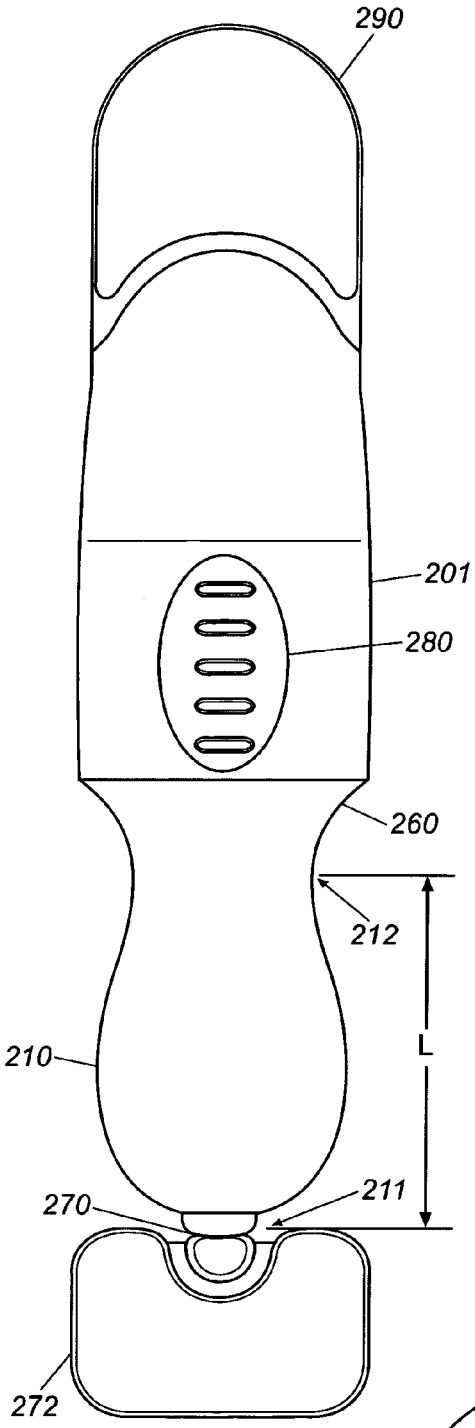
FIG. 2B shows a top elevation view of the device an illustrates an embodiment of the optional traction aid.
Figure 2C:
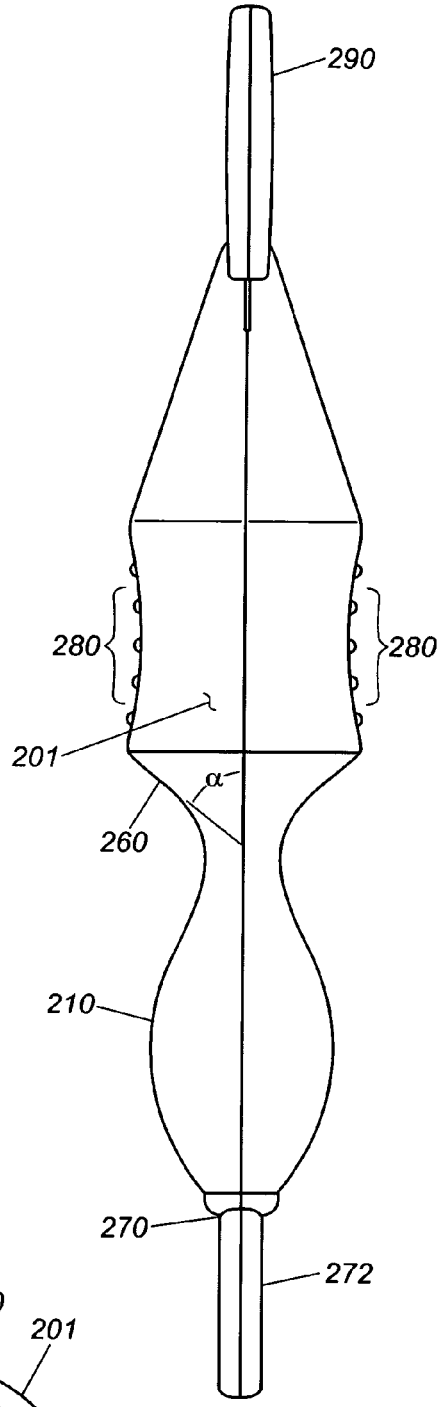
FIG. 2C is a right side elevation view showing an embodiment of the optional traction aid on the top and bottom of the reservoir.
Figure 4A:
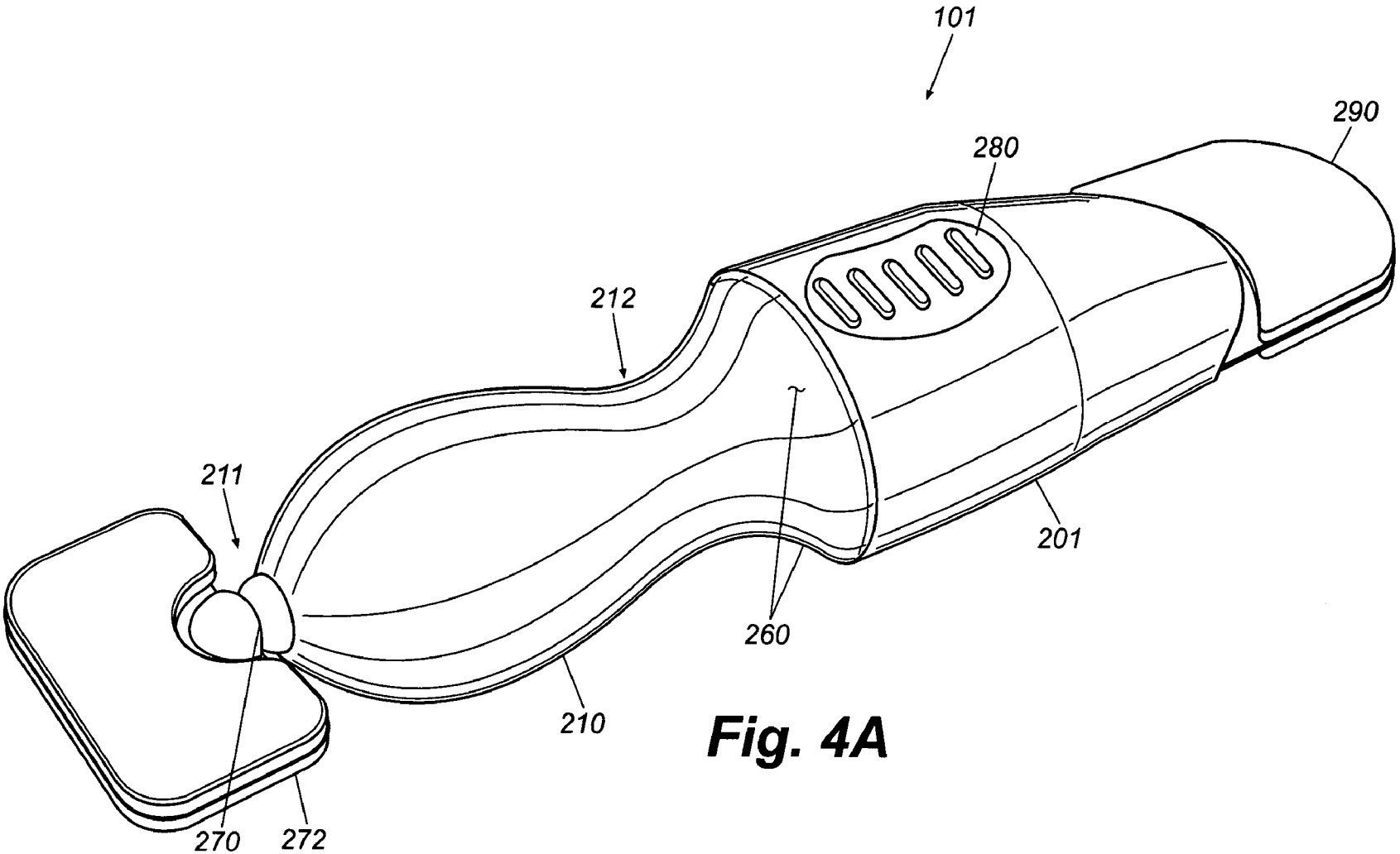
FIG. 4A shows a perspective view of the device and illustrating the breakable seal where the seal and tab are in place prior to removal.
Figure 4B:
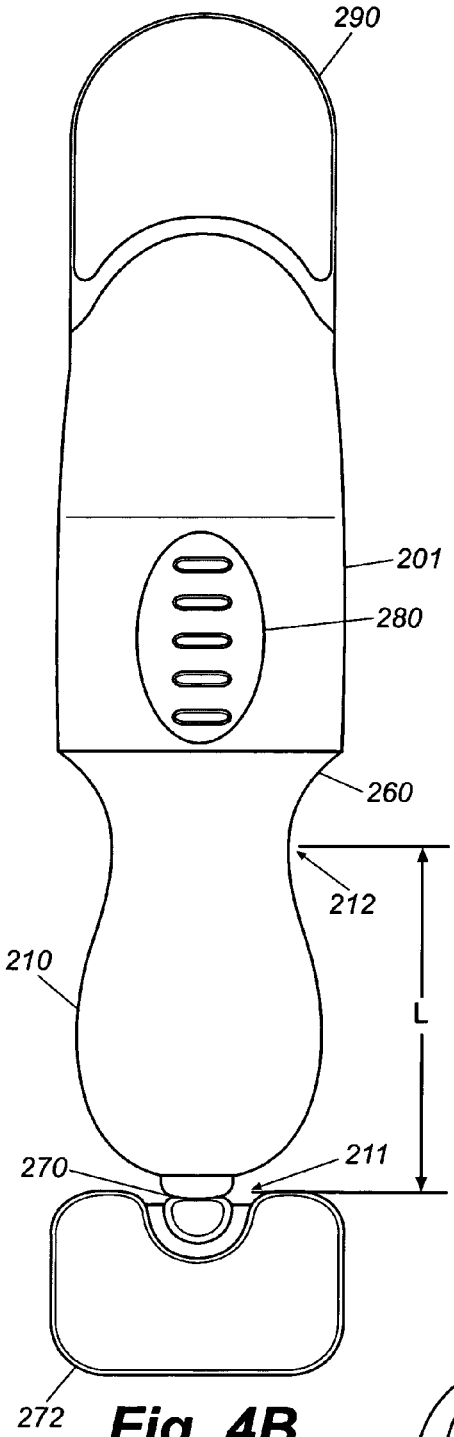
FIG. 4B shows a top elevation view of the device an illustrates an embodiment of the optional traction aid.
Figure 4C:
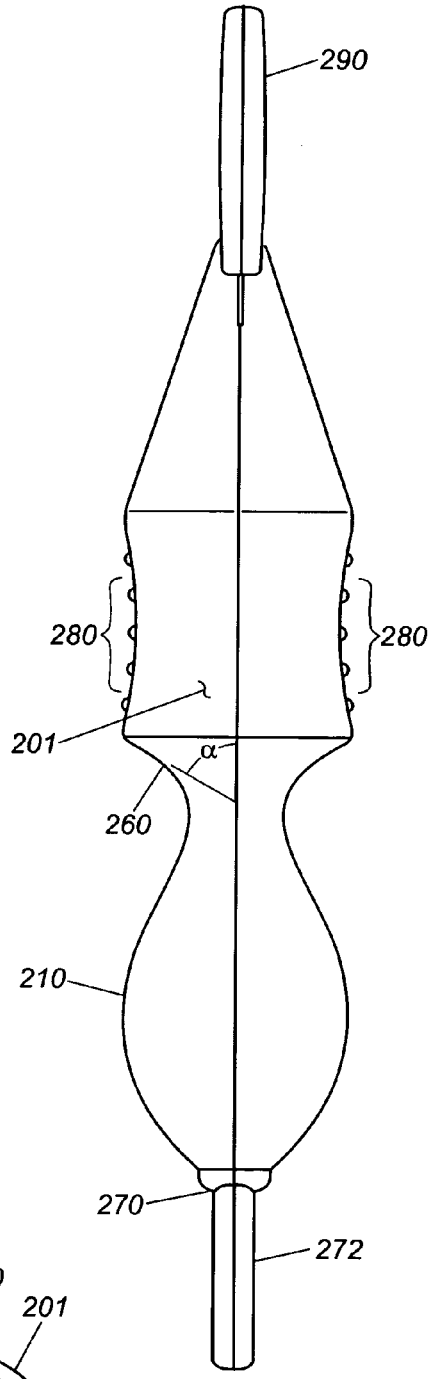
FIG. 4C is a right side elevation view showing an embodiment of the optional traction aid on the top and bottom of the reservoir.

In order to improve the gripping characteristics of the dispensing container [101], the squeezable reservoir [201] can have an outer surface having a traction aid thereon [280], whereby the traction aid improves the grip of the container by the user, or the person administering the liquid, if different from the user. The traction aid [280] comprises at least one of ribs, grooves, a roughened area, or a checkered area, or the like. An example of this feature can be seen in FIGS. 1A and 1B, FIGS. 2A, 2B, and 2C, and FIGS. 4A, 4B, and 4C, where a section of the outer surface of the top of the squeezable reservoir is shown to have grooves or ridges as a traction aid [280] for gripping the device. The grooves and/or ridges can be substantially straight and perpendicular to the longitudinal axis of the container, or they can be curved, angled, or of any other shape. In FIGS. 2C and 4C, an embodiment of the traction aid [280] is present on the top and bottom surfaces of the device. The examples of the traction aid that are shown are shaped in an oval configuration with crosswise molded grooves and ridges.

The present traction aid can be placed on the dispensing container at any location where improved gripping is desirable. For example, this can be on the top, bottom, top and bottom, and/or the sides of the dispensing container.

The traction aid can be can be added to the dispensing container [101] at any time. For example, it may be molded into the device during manufacture, or it may be machined into the surface of the device any time after manufacture. It is preferable, however, that the traction aid be molded integrally into the surface of the device at the time of manufacturing.

One part of the dispensing container [101] is the nipple dispensing head [210] that is integral with the squeezable reservoir [201], and which has a distal end [211] and a proximal end [212]. Typically an outlet [220] is located at the distal end [211] of the dispensing head [210] for dispensing the liquid [301] from the container. The proximal end [212] of the dispensing head [210] abuts the stop [260]. For the purposes of describing the length of the nipple dispensing head [210], the proximal end of the nipple dispensing head is to be understood to be at the narrowest (smallest cross-section) area between the stop [260] and the nipple dispensing head [210]. The distal end of the nipple dispensing head [211] is understood to be at the outlet [220]. As an example, the length of an embodiment of the present nipple dispensing head is illustrated as the dimension "L" in FIG. 2B.

The distal end of the nipple dispensing head [210] can be connected to the stop [260] at any location relative to the longitudinal axis of the device [101]. While it has been shown to be preferred that the nipple dispensing head [210] is centered on the longitudinal axis, namely, close to or at the center line of the device, as is illustrated in the present figures, it could also be located offset from the longitudinal axis, near the top or bottom of the device, or at any other location relative to the longitudinal axis.

Figure 2D:
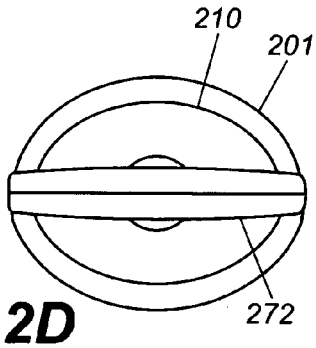
FIG. 2D is a front elevation view of the device showing the integral tab in place and the breakable seal intact, and showing that the nipple dispensing head has a generally oval cross-section.
Figure 4D:
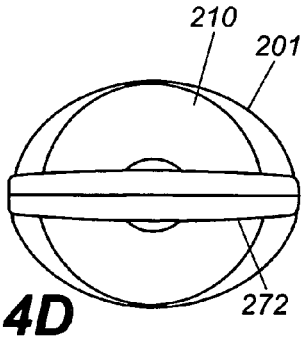
FIG. 4D is a front elevation view of the device showing the integral tab in place and the breakable seal intact, and showing that the nipple dispensing head has a generally round cross-section.

The nipple dispensing head [210] is generally in the shape of a nipple of the type used on baby bottles or infant pacifiers. The nipple dispensing head can be of any general shape, and can have a cross-section that is generally round, oval, square, rectangular, triangular, pentagonal, hexagonal, heptagonal, octagonal, irregular, or any combination of any of these shapes. However, it has been found that a nipple dispensing head having a generally round or oval cross-section, as shown in FIGS. 4D and 2D, respectively, is preferred. In particular, an oval cross-section of the type illustrated in FIG. 2D, for example, is more preferred.

Although the nipple dispensing head [210] can have a constant diameter along its length, as shown, for example, in U.S. Pat. No. 6,138,848 (or, in the case of an oval, constant values of the maximum and minimum diameters of the oval), it is preferred that the nipple dispensing head have a cross-section that is larger at some point along the length proceeding from the proximal end [212] end to the distal end [211] than the cross-section at the proximal end [212]. In other words, that it has the general shape of a nipple such as shown in U.S. Pat. No. D486,579, or D459,815.

When the present device is formed by the operation of blow-molding, the nipple dispensing head [210], the stop [260], the reservoir [201], as well as all other parts of the device are integral and unitary. The dispensing head [210] can be of any dimensions that are suitable for its use. In general, dimensions that are of interest are the length of the nipple dispensing head [210] as measured from the proximal end [212] to the distal end [211], and the diameter of the dispensing head in cross-section, if round or oval. In general, it is preferred that the length of the nipple dispensing head from the distal end to the proximal end is between about 0.5 inches (1.3 cm) and 2 inches (5 cm); a length of between about 0.75 inches (1.9 cm) to about 1.5 inches (3.8 cm) is more preferred, and a length of about 0.75 inches (1.9 cm) is even more preferred.

If the nipple dispensing head is round in cross-section, such as shown, for example, in FIG. 4D, the diameter can be between about 0.25 inches (0.6 cm) and about 1 inch (2.54 cm), but a diameter of between about 0.4 inches (1 cm) and about 0.6 inches (1.5 cm) is more preferred.

If the nipple dispensing head is generally oval in cross-section, it has been found that the smaller diameter of the oval can be between about 0.25 inches (0.6 cm) to about 0.5 inches (1.2 cm), while the larger diameter of the oval can be between about 0.3 inches (0.75 cm) and about 0.75 inches (1.9 cm).

A passage [240] interconnects the squeezable reservoir [201] and the outlet [220]. The purpose of the passage [240] is to provide a path whereby the liquid [301] in the reservoir [201] can be delivered to the outlet [220] at the distal end [211] of the dispensing head [210]. The passage can be of any shape or size suitable to deliver the liquid to the outlet. An advantage of location of the outlet [220] at the distal end of the nipple dispensing head [210] is that this location insures that the liquid contents of the container are delivered deep into the mouth of the user, thereby preventing or reducing the rejection or spillage of the liquid as can occur if it is presented in the bowl of a spoon, for example.

The outlet [220] is formed when the breakable seal [270] is broken and removed from its initial position covering the outlet and sealing the container. The outlet can have any shape. For example, the outlet can be oval, rectangular, square, circular, or any other shape. It is preferred, however, that the outlet is substantially circular in shape.

A feature of the present dispensing container is a stop [260], which is disposed near the proximal end [212] of the nipple dispensing head [210]. The stop prevents over-insertion of the nipple dispensing head into a user's mouth. As used herein, the term "over-insertion" means the insertion of a device into the mouth of a user to a depth that causes choking, or blockage of oral air or throat passages. In one embodiment, the stop [260] is located at the proximal end [212] of the dispensing head [210] and extends outwardly from the longitudinal axis of the nipple dispensing head at an acute angle of from about 30° to about 90° from the plane of the longitudinal axis of the nipple dispensing head. In a preferred embodiment, the stop extends outwardly from the longitudinal axis of the dispensing head at an angle of about 60°.

The purpose of the stop [260] is to arrest the penetration of the dispensing head into the mouth of the user. It is desirable, therefore, that the stop be large enough to accomplish this task. Because this feature is particular advantageous when the user is an infant, it is preferred that the stop extends outwardly from a surface of the nipple dispensing head a distance sufficient to prevent or retard the continued insertion of the dispensing container into the mouth of an infant past the stop.

In one embodiment of the present dispensing container [101], the stop is a portion of the outer surface of the reservoir [201]. This is illustrated, for example, in FIGS. 1A, 1B, 2A, 2B, 2C, 3A, 3B, and 4A, 4B, and 4C, where the stop [260] is shown as the outside surface of the front wall of the squeezable reservoir [201].

The present dispensing container [101] can also be made to have a tail [290]. The tail can be of any shape, but is typically substantially flat and is disposed from the reservoir [201] at a location that is opposite the nipple dispensing head [210] and in a plane that is substantially aligned with the longitudinal axis of the nipple dispensing head. This position of the tail [290] is illustrated, for example, in FIGS. 1A and 1B, among others. A useful feature of the tail is that it increases the gripping surface of the dispensing container, and, optionally, it can be used to display information relating to some characteristic of the dispensing container or its contents. By way of example, such information can include the volume of the liquid contained in the reservoir, the date of manufacture of the liquid, the date of filing the container, the date of recommended use for the liquid, the expiration date for the liquid, the chemical name of the liquid, the catalog or lot number of the liquid, or the common name of the liquid, or the like.

Also within the scope of the present invention is a dispensing container having a liquid therein. The container comprises a squeezable reservoir that contains the liquid; a nipple dispensing head which is integral with the squeezable reservoir and having a distal end and a proximal end; an outlet at the distal end of the nipple dispensing head for dispensing the liquid from the container; a passage interconnecting the squeezable reservoir and the outlet; and a stop disposed near the proximal end of the nipple dispensing head to prevent over-insertion of the nipple dispensing head into a user's mouth when the container is used to dispense liquid to the user.

FIGS. 3A and 3B illustrate several features of an embodiment of a dispensing container. For example, these figures illustrate the dispensing container [101] having a liquid [301] in the squeezable reservoir [201].

The present device can be used to contain and dispense almost any liquid that is suitable for administration to a user. As the term "liquid", is used herein, it should be understood to include a clear liquid, a paste, suspension, emulsion, microemulsion, or any other material having the general flow characteristics of a liquid. It is preferred that the viscosity of the liquid is from about 0.05 to about 1,000,000 centipoise at room temperature. Viscosities may also range from about 0.5 to about 20,000 centipoise and from about 1.0 to about 10,000 centipoise, with a viscosity of from about 1.0 to about 1,500 centipoise being even more preferable.

The present dispensing container is useful for administering a liquid to a user. In particular, it is useful for delivering a measured amount of a liquid to the user. As mentioned above, this characteristic is desirable when administering liquids to users where the amount of the liquid that is delivered to the user is important, such as, for example, the administration of drugs, neutraceuticals, vitamins, or medicines. In a preferred embodiment, the liquid [301] is selected from vitamins, over-the-counter drugs, or prescription drugs.

When the liquid [301] is added to the squeezable reservoir [201] of the present device, it is sometimes desirable, although not required, that the reservoir also contain a gas in the head-space of the reservoir. In some embodiments, it is desirable to control the type of gas that is added, such as, for example, when it is desirable to have an inert gas in the head-space. This can be done by controlling the type of gas that is added to the head-space, and/or the pressure of the head-space gas. In FIG. 3A and FIG. 3B, the head-space gas is illustrated as [305].

Although a gas for the head-space [305], if one is used, can be almost any gas, it is preferred that the head-space gas comprises air, sterile air, oxygen gas, nitrogen gas, other inert gas, or a mixture thereof. In like manner, although the head-space gas can be included in the reservoir at almost any pressure which the reservoir will withstand, it is preferred that the head-space gas in the reservoir is at a pressure of from 0 to about 3 bar gauge, with a pressure of from about 0 to about 1 bar gauge being more preferred. In some embodiments, a vacuum may be present in the head-space so that the pressure is actually less than 0 bar gauge. However, most embodiments of the present invention will have atmospheric pressure (e.g., 0 bar gauge) in any head-space. The exact pressure employed may vary depending on the viscosity of the liquid being used.

The present dispensing container can be made by any method. However, it has been found that a preferred method for manufacturing the device is by blow-fill-seal technology. Information about blow-fill-seal technology can be found, for example, in Blow-Fill-Seal Technology, R. Oschmann et al., CRC Press, Boca Raton, Fla. (1999), or in Blow-Fill-Seal—Advanced Aseptic Processing, D. Jones, published in Encyclopedia of Pharmaceutical Technology, 2nd Ed., Marcel Dekker, Inc., New York, N.Y. (2002). Blow-fill-seal systems and equipment are available from several manufacturers, such as Rommelag USA, Inc., Edison, N.J.

The present invention is also directed to a novel method of making a dispensing container having a liquid therein, the method comprising: extruding a polymer into a blow mold; closing the mold; forming a dispensing container comprising a squeezable reservoir designed to contain the liquid, a nipple dispensing head which is integral with the squeezable reservoir and having a distal end and a proximal end, an outlet at the distal end of the nipple dispensing head for dispensing liquid from the container, a passage interconnecting the squeezable reservoir and the outlet, and a stop disposed near the proximal end of the nipple dispensing head to prevent over-insertion of the nipple dispensing head into a user's mouth when the container is used to dispense liquid to the user; adding the liquid to the dispensing container; sealing the outlet with a breakable seal; and removing the sealed liquid-filled dispensing container from the mold.

A useful feature of a preferred embodiment of the present dispensing container is that it is unitary. That is, all parts are interconnected and, other than the tab and breakable seal, are not intended to be separable. When the dispensing container is produced by a blow-fill-seal method, all parts of the device are composed of one contiguous piece of polymer. Advantages of unitary construction include ease of maintaining integrity of the contents, maintenance of sterility, high resistance to tampering, low cost of manufacturing, and ease of use and disposal.

Almost any thermoplastic or thermoset polymer can be used for the production of the present dispensing container. However, it is preferred that the polymer is one that can be extruded. Examples of polymers that are useful for the production of the present invention include, without limitation, polyethylene, polypropylene, ethyl vinyl alcohol copolymer, cyclic olefin copolymer, cyclic olefin polymer, liquid crystal polymer, polyethylene terephthalate, anhydride modified polyolefin, polycarbonate, polyacrylic, polyacrylonitrile, polyvinylchloride, polystyrene, a fluoropolymer, a thermoplastic polyester, nylon, or a mixture of any of these.

Examples of polymers that are preferred for use in the present device include low-density polyethylene, high-density polyethylene, linear low density polyethylene, medium density polyethylene, oriented polyethylene terephthalate, polyethylene terephthalate copolymer, anhydride modified ethylene vinyl acetate, anhydride modified low density polyethylene, anhydride modified linear low density polyethylene, polybutylene terephthalate, crystalline nylon, amorphous nylon, MXD6, or mixtures thereof. It is more preferred that the polymer from which the present device is made is low-density polyethylene, high-density polyethylene, medium density polyethylene, or polypropylene.

Polymers that are useful for the production of the present container can also be intermixed with any type of additive that is typically used in polymer processing and which does not interact undesirably with the liquid. Additives such as: UV stabilizers, thermal stabilizers, processing aids, nucleating agents, clarifiers, and antistatic agents may be added to the resins above during the production of the container at any percent loading.

Polymers that are useful for the production of the present device can be characterized by their melt index. As used herein, the terms "melt index" mean the number of grams of a polymer that can be forced through a 0.0825 inch orifice in 10 minutes at 190° C. by a pressure exerted by a mass of 2160 g (43.25 psi). In preferred embodiments, the polymer has a melt index between about 0.1 and 200 g/10 min and more preferred is a polymer having a melt index between about 0.1 to about 20 g/10 min. The melt index will depend on the particular polymer chosen in order to provide the container with the desired characteristics for its operating environment to allow successful transfer of any liquid contained therein.

In some embodiments of the present dispensing container, it is preferred that the polymer is sufficiently transparent or translucent that the amount or condition of liquid in the reservoir can be determined visually. This is particularly useful to determine whether the full amount of the contents of the reservoir have been expelled when the device is used. Also, this feature is useful when the visible features of the liquid indicate some characteristic, such as, for example, when cloudiness of the liquid could indicate contamination, or excess aging, or the like. In other embodiments, it may be advantageous for the reservoir to be shielded from light, such as, for example, when the liquid contents include a light-sensitive material. In these embodiments, light shielding can be provided by the use of an opaque polymer, a polymer filled with a light-shielding material, or the like.

In some embodiments of the liquid-filled dispensing container, the dispensing container can be color-coded to identify a property of the liquid in the reservoir. This is particularly useful when it is desirable to provide a clear and easily understood signal of some characteristic of the device or its contents. For example, a red container could signify contents requiring particular care in use, or the like. A blue container could indicate liquid contents requiring refrigeration, or the like.

In a preferred method, the polymer is extruded into the blow mold in the form of a parison. As used herein, the term "parison" means an extruded tube of plastic or polymer. Further preferred, is a method wherein the dispensing container is formed from a single piece of polymer. However, the parison is optionally formed from a single polymer, a blend of two or more polymers, or a multilayer structure comprising two or more layers of the same or different polymers. The polymeric materials may be used as a single layer in a monolayer structure for the present device, or as a layer in a multi-layer structure. The multi-layer structure may be manufactured using co-extrusion. The multi-layer structure may consist of any combination of polymers listed above and in any order and any frequency.

The step of forming a dispensing container can be accomplished by applying the mold around or onto the parison and applying a vacuum to the mold surface followed by the application of compressed gas or vacuum to the mold. In an embodiment of the present method, the step of closing the mold can form the breakable seal [270] and integral tab [272] to seal the outlet [220] of the container. Alternatively, the step of closing the mold can seal one end of the reservoir by forming the tail [290] of the dispensing container. The operation of a blow-fill-seal system to form aseptic packages is well known in the art.

One feature of the present method is the control of the thickness of the walls of the squeezable reservoir. This parameter, along with the characteristics of the polymer that is used, controls the degree of pressure that is required to collapse the walls of the reservoir and express the liquid [301] from the outlet [220] of the device, after the breakable seal is removed. In one embodiment, the thickness of the wall of the squeezable reservoir is from about 0.01 mm to about 5 mm, preferably from about 0.01 mm to about 3 mm, and more preferably from about 0.05 to about 1 mm.

The polymer is typically extruded from the outlet of an extruder at a temperature that is above its glass transition temperature and in the form of a parison. The polymer then enters the blow mold at or very near this temperature. It is preferred that the temperature of the polymer entering the blow mold is between about 50° C. and about 1000° C., more preferred is a temperature of between about 100° C. and about 500° C., and even more preferred is a temperature between about 100° C. and about 300° C. The exact temperature of the polymer entering the blow mold depends on the polymer chosen and the operating conditions and parameters of the molding and filling process.

As discussed above, the present method can also include the step of adding a head-space gas to the reservoir. Although the gas can be added at any temperature, it is preferred that the head-space gas is added to the reservoir at a temperature of between about 10° C. and 500° C., preferably between about 100° C. and about 500° C., and even more preferably between about 100° C. and about 300° C.

When the liquid is added to the reservoir, it can be added at any temperature at which it is stable, but often the liquid is added to the dispensing container at a temperature of from about 2° C. to about 65° C., and preferably from about 10° C. to about 50° C., and most preferably from about 15° C. to about 25° C.

The process may be carried out so that a sterile product is formed. For example, depending upon the sterility requirements of the liquid, the sterility of the liquid and gas in the reservoir can be closely controlled to yield a sterile charge in the reservoir.

When gas and/or liquid has been added to the reservoir, the dispensing container can be sealed by the action of an additional die that closes to seal the container. Preferably this step can be used to form a substantially flat tail [290] that is disposed from the reservoir opposite the nipple dispensing head and in a plane that is substantially aligned with the longitudinal axis of the dispensing head.

The molded, filled and sealed dispensing container is allowed to cool in the mold sufficiently to retain its shape, and then the mold is opened and the device is removed. Any desirable printing, labeling, or other information that is to be added to the device is then applied. When the device is ready for use, it can be packaged for storage, shipment, sale and use.

The present dispensing container is easily used by breaking the breakable seal and removing the removable part of the seal and the tab and inserting the nipple dispensing head into the mouth of the user into which the contents of the device are to be deposited, and using the fingers, or thumb and fingers, to squeeze the squeezable reservoir and express the liquid contents from the outlet.

All references cited in this specification, including without limitation all papers, publications, patents, patent applications, presentations, texts, reports, manuscripts, brochures, books, internet postings, journal articles, periodicals, and the like, are hereby incorporated by reference into this specification in their entireties. The discussion of the references herein is intended merely to summarize the assertions made by their authors and no admission is made that any reference constitutes prior art. Applicants reserve the right to challenge the accuracy and pertinency of the cited references.

In view of the above, it will be seen that the several advantages of the invention are achieved and other advantageous results obtained.

As various changes could be made in the above methods and compositions by those of ordinary skill in the art without departing from the scope of the invention, it is intended that all matter contained in the above description and shown in the accompanying drawings shall be interpreted as illustrative and not in a limiting sense. In addition it should be understood that aspects of the various embodiments may be interchanged both in whole or in part.

What is claimed is:

1. A dispensing container fillable with a liquid, the container comprising:

a squeezable reservoir for holding the liquid prior to dispensing;

a nipple dispensing head which is integral with the squeezable reservoir and having a distal end and a proximal end, wherein a first cross-sectional area of the nipple dispensing head is smaller at the nipple dispensing head's proximal end than at least one point nearer the nipple dispensing head's distal end, a second cross-sectional area of the nipple dispensing head is smaller at the nipple dispensing head's distal end than at least one point nearer the nipple dispensing head's proximal end, and a third cross-sectional area of the nipple dispensing head is between the first cross-sectional area and the second cross-sectional area and wherein the third cross-sectional area is larger than each of the first and second cross-sectional areas and wherein the nipple dispensing head has a diameter at its widest point of from about 0.6 cm to about 2.54 cm;

an outlet at the distal end of the dispensing head for dispensing the liquid from the container;

a passage interconnecting the squeezable reservoir and the outlet; and a stop disposed near the proximal end of the dispensing head to prevent over-insertion of the dispensing head into a user's mouth when the container is used to dispense the liquid to the user, wherein a cross-sectional area of the stop is larger than the first cross-sectional area of the nipple dispensing head.

2. The dispensing container according to claim 1, wherein the squeezable reservoir has an outer surface having a traction aid thereon, whereby the traction aids improve the grip of the container by the user.

3. The dispensing container according to claim 2, wherein the traction aid comprises at least one of ribs, grooves, a roughened area, or a checkered area.

4. The dispensing container according to claim 1, wherein the nipple dispensing head has a cross-sectional shape that is round or oval.

5. The dispensing container according to claim 1, wherein the length of the nipple dispensing head from the distal end to the proximal end is between about 0.5 inches (1.3 cm) and 2 inches (5 cm).

6. The dispensing container according to claim 1, wherein the length of the nipple dispensing head from the distal end to the proximal end is between about 0.75 inches (1.9 cm) to about 1.5 inches (3.8 cm).

7. The dispensing container according to claim 4, wherein the cross-section of the nipple dispensing head is oval and the nipple dispensing head is of a length of about 0.75 inches (1.9 cm) from the distal end to the proximal end.

8. The dispensing container according to claim 1, wherein the passage comprises a single channel interconnecting the squeezable reservoir and the outlet.

9. The dispensing container according to claim 1, wherein the outlet is closed by a breakable seal which is unitary with the dispensing container and which reveals the outlet when the seal is broken.

10. The dispensing container according to claim 9, wherein the breakable seal is integral with a tab which is designed for gripping between the thumb and forefinger for the purpose of breaking the seal.

11. The dispensing container according to claim 1, wherein the stop is located at the proximal end of the nipple dispensing head and extends outwardly from the nipple dispensing head at an angle of from about 30° to about 90° from the longitudinal axis of the nipple dispensing head.

12. The dispensing container according to claim 11, wherein the stop extends outwardly from the nipple dispensing head a distance sufficient to prevent or retard the continued insertion of the dispensing container into the mouth of an infant past the stop.

13. The dispensing container according to claim 1, further comprising a substantially flat tail disposed from the reservoir opposite the nipple dispensing head and in a plane that is substantially parallel to the longitudinal axis of the dispensing head.

14. A dispensing container having a liquid therein, the container comprising:

a squeezable reservoir containing the liquid;

a nipple dispensing head which is integral with the squeezable reservoir and having a distal end and a proximal end, wherein a first cross-sectional area of the nipple dispensing head is smaller at the nipple dispensing head's proximal end than at least one point nearer the nipple dispensing head's distal end, a second cross-sectional area of the nipple dispensing head is smaller at the nipple dispensing head's distal end than at least one point nearer the nipple dispensing head's proximal end, and a third cross-sectional area of the nipple dispensing head is between the first cross-sectional area and the second cross-sectional area and wherein the third cross-sectional area is larger than each of the first and second cross-sectional areas and wherein the nipple dispensing head has a diameter at its widest point of from about 0.6 cm to about 2.54 cm;

an outlet at the distal end of the dispensing head for dispensing the liquid from the container;

a passage interconnecting the squeezable reservoir and the outlet; and a stop disposed near the proximal end of the dispensing head to prevent over-insertion of the dispensing head into a user's mouth when the container is used to dispense the liquid to the user, wherein a cross-sectional area of the stop is larger than the first cross-sectional area of the nipple dispensing head.

15. The dispensing container according to claim 14, wherein the nipple dispensing head has a cross-sectional shape that is round or oval.

16. The dispensing container according to claim 15, wherein the dispensing container is unitary.

17. The dispensing container according to claim 15, wherein the cross-section of the nipple dispensing head is oval and is of a length of about 0.75 inches (1.9 cm) from the distal end to the proximal end.

18. The dispensing container according to claim 14, wherein the outlet is closed by a breakable seal which is unitary with the dispensing container and which reveals the outlet when the seal is broken.

19. The dispensing container according to claim 14, wherein the liquid comprises at least one material that is selected from vitamins, over-the-counter drugs, or prescription drugs.

20. The dispensing container according to claim 14, wherein the dispensing container is formed from a polymer which is sufficiently transparent or translucent that the amount of liquid in the reservoir can be determined visually.

21. The dispensing container according to claim 14, wherein the dispensing container is color-coded to identify a property of the liquid in the reservoir.

22. The dispensing container according to claim 14, wherein the dispensing container is formed from a single piece of polymer.

23. A method of making a dispensing container having a liquid therein, the method comprising:

extruding a polymer into a blow mold;

closing the mold;

forming a dispensing container comprising a squeezable reservoir for holding the liquid prior to dispensing;

a nipple dispensing head which is integral with the squeezable reservoir and having a distal end and a proximal end, wherein a first cross-sectional area of the nipple dispensing head is smaller at the nipple dispensing head's proximal end than at least one point nearer the nipple dispensing head's distal end, a second cross-sectional area of the nipple dispensing head is smaller at the nipple dispensing head's distal end than at least one point nearer the nipple dispensing head's proximal end, and a third cross-sectional area of the nipple dispensing head is between the first cross-sectional area and the second cross-sectional area and wherein the third cross-sectional area is larger than each of the first and second cross-sectional areas and wherein the nipple dispensing head has a diameter at its widest point of from about 0.6 cm to about 2.54 cm;

an outlet at the distal end of the dispensing head for dispensing the liquid from the container;

a passage interconnecting the squeezable reservoir and the outlet; and a stop disposed near the proximal end of the dispensing head to prevent over-insertion of the dispensing head into a user's mouth when the container is used to dispense the liquid to the user, wherein a cross-sectional area of the stop is larger than the first cross-sectional area of the nipple dispensing head;

adding the liquid to the dispensing container;

sealing the dispensing container; and removing the sealed dispensing container from the mold.

24. The method according to claim 23, wherein the polymer comprises a material that is selected from at least one of polyethylene, polypropylene, ethyl vinyl alcohol copolymer, cyclic olefin copolymer, cyclic olefin polymer, liquid crystal polymer, polyethylene terephthalate, anhydride modified polyolefin, polycarbonate, polyacrylic, polyacrylonitrile, polyvinylchloride, polystyrene, a fluoropolymer, a thermoplastic polyester, nylon, or a mixture thereof.

25. The method according to claim 23, wherein the polymer comprises a material that is selected from at least one of low-density polyethylene, high-density polyethylene, linear low density polyethylene, medium density polyethylene, oriented polyethylene terephthalate, polyethylene terephthalate copolymer, anhydride modified ethylene vinyl acetate, anhydride modified low density polyethylene, anhydride modified linear low density polyethylene, polybutylene terephthalate, crystalline nylon, amorphous nylon, MXD6, or mixtures thereof.

26. The method according to claim 23, wherein the polymer is extruded into the blow mold in the form of a parison.

27. The method according to claim 26, wherein the parison is optionally formed from a single polymer, a blend of two or more polymers, or a multilayer structure comprising two or more layers of the same or different polymers.

28. The method according to claim 23, wherein the step of closing the mold forms a breakable seal that covers the outlet, wherein the seal is optionally attached to an integral tab.

29. The method according to claim 23, wherein the step of sealing the container comprises forming a substantially flat tail disposed from the reservoir opposite the dispensing head and in a plane that is substantially parallel to the plane of the dispensing head.

30. The method according to claim 23, wherein the thickness of the wall of the squeezable reservoir is from about 0.01 mm to about 3 mm.

31. The method according to claim 23, further comprising the step of adding a head-space gas to the reservoir.

* * * * *